US007305338B2

(12) United States Patent
Tashiro et al.

(10) Patent No.: US 7,305,338 B2
(45) Date of Patent: Dec. 4, 2007

(54) APPARATUS AND METHOD FOR CONCEALING ERASED PERIODIC SIGNAL DATA

(75) Inventors: Atsushi Tashiro, Kanagawa (JP); Hiromi Aoyagi, Kanagawa (JP); Masashi Takada, Kanagawa (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 43 days.

(21) Appl. No.: 10/553,905

(22) PCT Filed: May 14, 2004

(86) PCT No.: PCT/JP2004/006893

§ 371 (c)(1),
(2), (4) Date: Oct. 21, 2005

(87) PCT Pub. No.: WO2004/102531

PCT Pub. Date: Nov. 25, 2004

(65) Prior Publication Data

US 2006/0224388 A1 Oct. 5, 2006

(30) Foreign Application Priority Data

May 14, 2003 (JP) ..... 2003-136338

(51) Int. Cl.
*G10L 21/02* (2006.01)
*G10L 19/14* (2006.01)

(52) U.S. Cl. ..... 704/228; 704/211; 704/201

(58) Field of Classification Search ..... None
See application file for complete search history.

(56) References Cited

U.S. PATENT DOCUMENTS 5,450,449 A * 9/1995 Kroon ..... 375/350
5,699,485 A * 12/1997 Shoham ..... 704/223
6,584,104 B1 * 6/2003 McGowan ..... 370/394
6,584,438 B1 * 6/2003 Manjunath et al. ..... 704/228
6,636,829 B1 * 10/2003 Benyassine et al. ..... 704/201
6,775,649 B1 * 8/2004 DeMartin ..... 704/201
6,952,668 B1 * 10/2005 Kapilow ..... 704/206

FOREIGN PATENT DOCUMENTS

WO WO 00/63881 A 10/2000

OTHER PUBLICATIONS

International Telecommuinication Union, ITU-T, G.711, Appendix 1, dated Sep. 1999.

Goodman et al., "Waveform Substitution Techniques for Recovering Missing Speech Segments in Packet Voice Communications", dated Dec. 1986, IEEE, pp. 1440-1448.

* cited by examiner

*Primary Examiner*—David Hudspeth
*Assistant Examiner*—Brian L. Albertalli
(74) *Attorney, Agent, or Firm*—Venable LLP; Michael A. Sartori; Catherine M. Voorhees

(57) ABSTRACT

Circuitry and a method compensate the erasure of speech signal data or similar periodic signal data, by substitution using past periodic signal data input. After a predetermined number of latest periodic signal data have been saved, whether or not an erasure occurs is determined with every periodic signal data sequence, which is a unit of processing. When an erasure occurs, one of periodic signal data sequences saved, which lies in a determined segment to be used, is used to generate synthetic data for substitution. The position of the segment to be used is determined such that when the erasure continues over units of processing, the position sequentially varies gradually for each processing units.

12 Claims, 8 Drawing Sheets

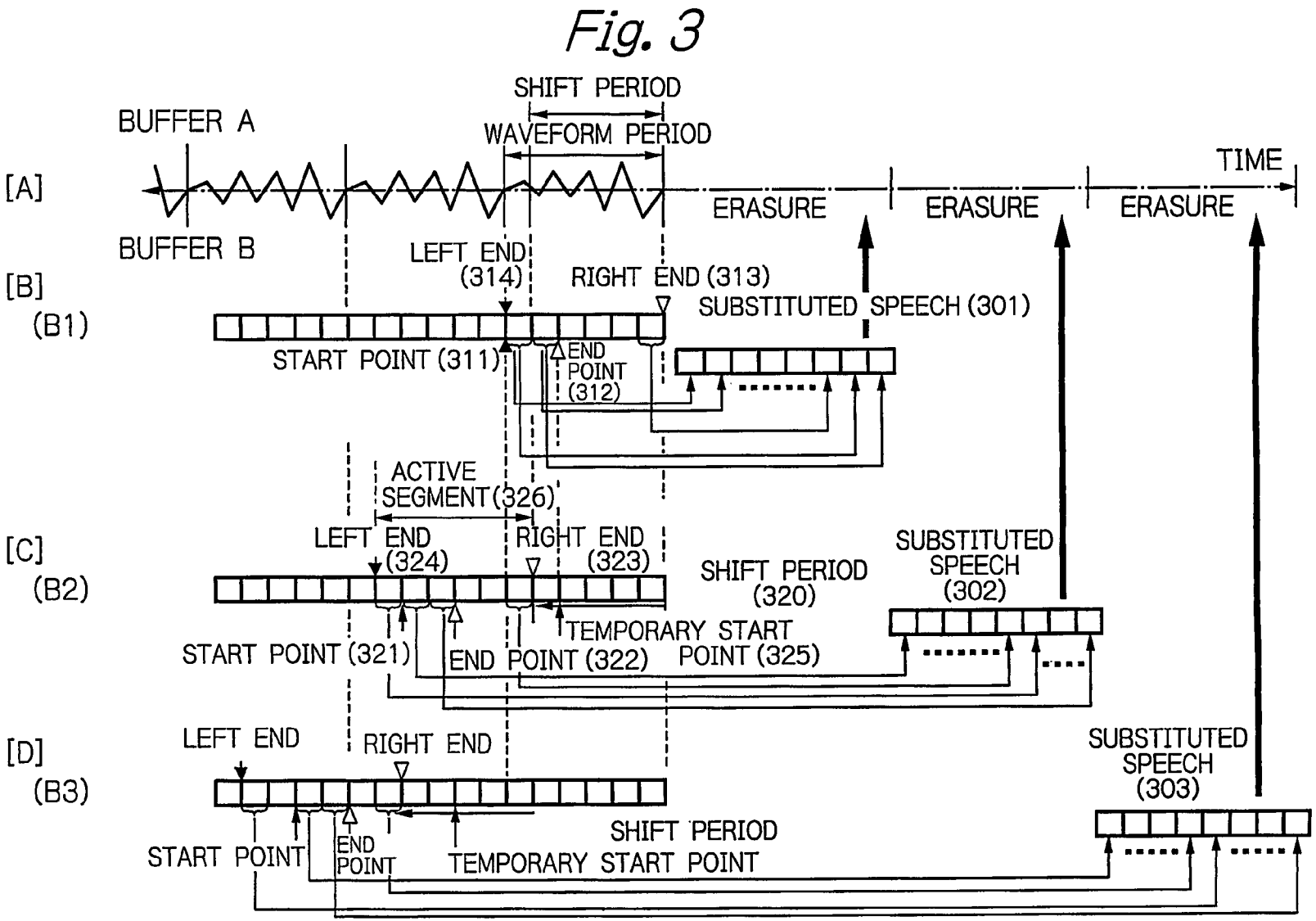
Fig. 3
TIME
ERASURE
ERASURE
ERASURE
SHIFT PERIOD
WAVEFORM PERIOD
BUFFER A
BUFFER B
[A]
[B]
(B1)
SUBSTITUTED SPEECH (301)
RIGHT END (313)
END POINT (312)
LEFT END (314)
START POINT (311)
[C]
(B2)
SUBSTITUTED SPEECH (302)
SHIFT PERIOD (320)
TEMPORARY START POINT (325)
RIGHT END (323)
TEMPORARY END POINT (322)
ACTIVE SEGMENT (326)
LEFT END (324)
START POINT (321)
[D]
(B3)
SUBSTITUTED SPEECH (303)
SHIFT PERIOD
TEMPORARY START POINT
RIGHT END
END POINT
LEFT END
START POINT

APPARATUS AND METHOD FOR CONCEALING ERASED PERIODIC SIGNAL DATA

BACKGROUND OF THE INVENTION

1. Field of the Invention

The present invention relates to compensating circuitry for compensating erased periodic signal data and a compensating method therefor, and is applicable to, e.g. the compensation of the erasure of a speech signal.

2. Description of the Background Art

While speech communication over Internet or similar communication network is extensively used today, it is likely that speech sent over a network is partly erased or lost, resulting in the degradation speech quality. To improve degraded speech quality, a method taught in ITU-T (International Telecommunication Union-Telecommunication Standardization Sector) Recommendation G.711 Appendix I is available.

In accordance with the method taught in the above document, a coded speech signal arrived over a network is decoded by a speech decoder and then input to a compensating circuitry. The compensating circuitry monitors the input decoded speech signal on a speech frame basis, which is the unit of speech signal decoding, and executes compensation every time the erasure of speech occurs. More specifically, when any speech is missing, the compensating circuitry determines a period or waveform frequency around the time when an erasure has occurred on the basis of speech data stored in, e.g. a memory included in the circuitry, and received just before the above time. Subsequently, the compensating circuitry reads out the speech data stored in the memory, and substitutes the data for a frame which the erasure is associated with and requires speech signal substitution, such that the start phase of the frame coincides with the end phase of the immediately preceding frame to thereby maintain continuity in waveform period.

The memory of the compensating circuitry has a storage capacity large enough to store speech data over, e.g. up to three consecutive waveform periods, so that an undesirable tone ascribable to a single continuous waveform can be obviated by use of the three waveform periods of speech data. Should only one waveform period of speech data be saved, it would cause unnecessary tones to generate when repeatedly used for substitution.

However, saving up to three waveform periods of speech data for the compensation of an erasure is not practicable without scaling up the memory and access configuration thereof and therefore the entire compensating circuitry. In addition, when erasure frames occur successively, the section for use in forming substitution data under speech was expanded by a multiple of the waveform period. Therefore, when erasure frames come successively, data under speech available for forming substitution data would resultantly be obtained from the longer section. Accordingly, the naturality in tonal fluctuation of a substituted speech may be spoiled.

SUMMARY OF THE INVENTION

It is an object of the present invention to provide compensating circuitry free from the drawback stated above and capable of concealing the partial erasure of a periodic signal and a compensating method therefor.

In accordance with the present invention, compensating circuitry for substituting past periodic signal data input for erased periodic signal data includes a past data saving circuit for saving a predetermined number of latest periodic signal data input. A decision circuit determines whether or not an erasure occurs with every periodic signal data sequence, which is a unit of processing. When an erasure occurs, a substituting circuit uses, among periodic signal data sequences saved in the past data saving circuit, a periodic signal data sequence lying in a predetermined segment to be used to generate synthetic data for substitution or interpolation. When the erasure continues over a plurality of units of processing, a position controller determines a position of the segment to be used such that the position varies for each of the units of processing.

Also, in accordance with the present invention, a compensating method of substituting past periodic signal data input for erased periodic signal data begins with a past data saving step of saving a predetermined number of latest periodic signal data input. Whether or not an erasure occurs is determined with every periodic signal data sequence, which is a unit of processing. When an erasure occurs, a periodic signal data sequence lying in a predetermined segment to be used is used among periodic signal data sequences saved in the past data saving step to generate synthetic data for substitution or interpolation. Further, when the erasure continues over a plurality of units of processing, a position of the segment to be used is determined such that the position varies for each of the units of processing.

BRIEF DESCRIPTION OF THE DRAWINGS

The objects and features of the present invention will become more apparent from consideration of the following detailed description taken in conjunction with the accompanying drawings in which:

FIG. 3 demonstrates a procedure to be executed by the illustrative embodiment for generating synthetic speech data for substitution;

DESCRIPTION OF THE PREFERRED EMBODIMENTS

Figure 1:
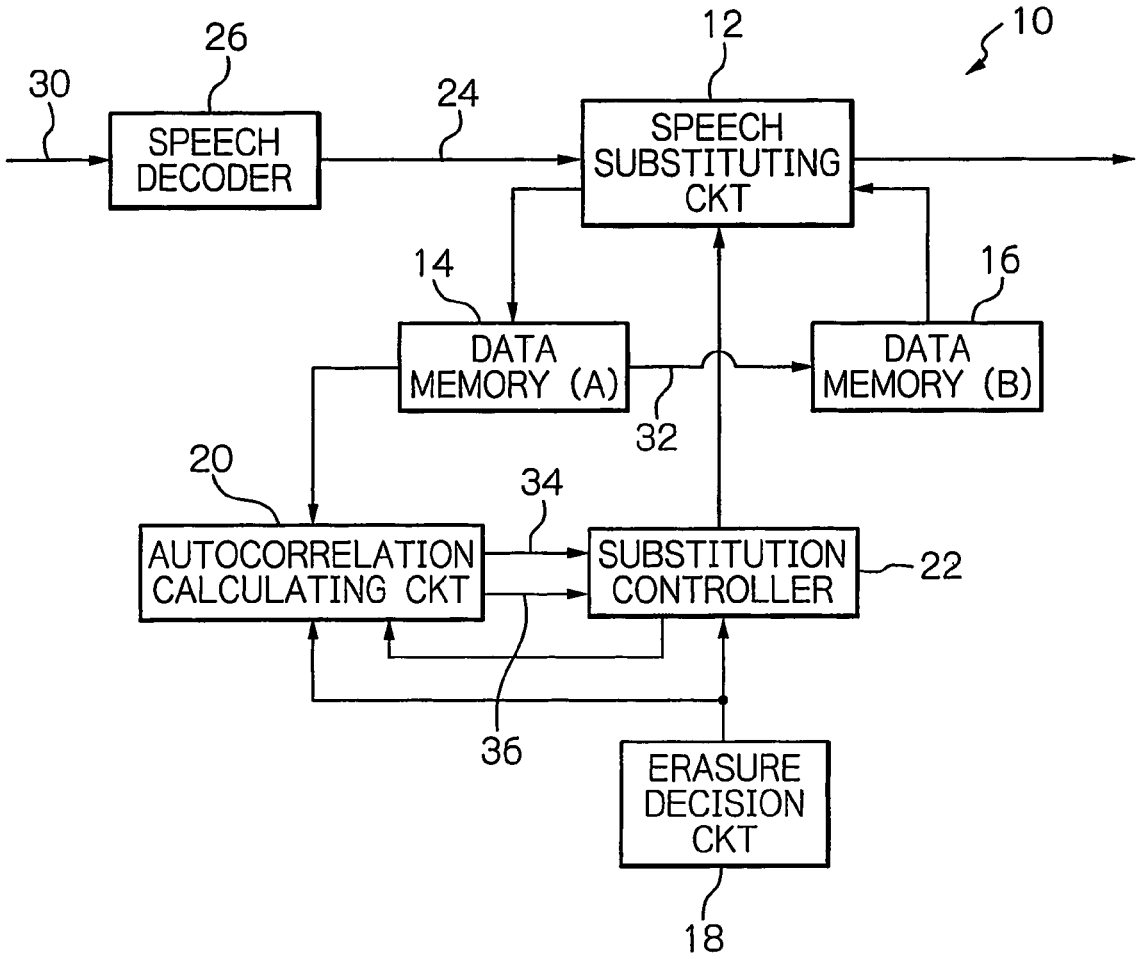
FIG. 1 is a schematic block diagram showing erasure compensating circuitry embodying the present invention.

Referring to FIG. 1 of the drawings, speech erasure compensating circuitry embodying the present invention is applied to a speech signal by way of example. It is to be noted that the circuitry shown in FIG. 1 may be implemented entirely by hardware or partly by software so long as it can achieve functions to be described hereinafter.

As shown in FIG. 1, the speech erasure compensating circuitry, generally 10, includes a speech substituting circuit 12, two data memories (A) 14 and (B) 16, an erasure decision circuit 18, an autocorrelation calculating circuit 20 for detecting a period of speech data, and a substitution controller 22 interconnected as illustrated. The circuitry 10 also includes a speech decoder 26, which is adapted to decode speech data received over a network on its input port 30 and has its output port 24 connected to the input of the speech substituting circuit 12.

Receiving decoded speech data from the speech decoder 26 via the input 24, the speech substituting circuit 12 simply passes the speech data therethrough if the speech data are not erased. If the speech data are erased, the speech substituting circuit 12 performs substitution or interpolation by using speech data stored in the data memory 16 under the control of the substitution controller 22.

Non-erased speech data, sometimes referred to as complete speech data in the context, output from the speech decoder 26 are input to the data memory 14 via the speech substituting circuit 12 and used for the compensation of an erasure. In the illustrative embodiment, the duration of speech data to be saved in the data memory 14 is shorter than with the conventional circuitry. For example, the data memory 14 has its storage capacity just large enough to store a few waveform periods of speech data at most. The waveform period of speech data lies in the range of 5 to 15 milliseconds although it can, of course, be suitably selected by a designer. The data memory 14 has its output 32 connected to the other data memory 16.

When the substitution of speech data should be executed, the speech data stored in the data memory 14 are copied into the data memory 16. This allows, even when speech data stored in the data memory 14 are updated, speech data having appeared just before substitution to be preserved in the data memory 16.

The erasure decision circuit 18 determines whether or not speech data are erased. For example, if the frame number representative of the order of speech frames having arrived is not obtained, if the frame number obtained is the same as the past frame number, or if the frame number is obtained but speech data associated therewith cannot be decoded due to, e.g. an error detected, then the erasure decision circuit 18 determines that the speech data of the frame designated by the frame number in question are missing. The function of the erasure decision circuit 18 may be assigned to the speech decoder 26, if desired. In any case, the erasure decision circuit 18 forms part of the speech erasure compensating circuitry 10. The result of decision output from the erasure decision circuit 18 is delivered to the substitution controller 22 and autocorrelation calculating circuit 20.

When speech data are missing, the autocorrelation calculating circuit 20 calculates, under the control of the substitution controller 22, the autocorrelation value of a speech data sequence saved in the data memory 14 and then produces a waveform period 34 and a shift period 36 from the autocorrelation value, thereby detecting synchronization. The waveform and shift periods 34 and 36 thus produced are fed to the substitution controller 22.

Figure 2:
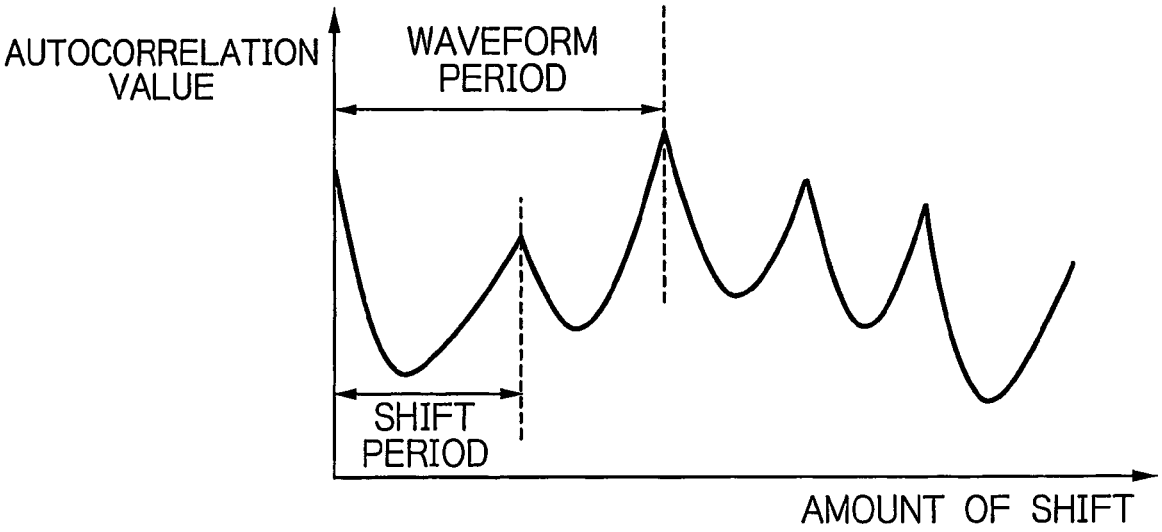
FIG. 2 is a graph plotting a specific result of processing executed by an autocorrelation calculating circuit included in the illustrative embodiment.

FIG. 2 is a graph plotting a specific result of calculation output from the autocorrelation calculating circuit 20; the abscissa indicates the amount of shift while the ordinate indicates an autocorrelation corresponding to the amount of shift. A waveform period refers to conventional basic information on a period particular to a speech data sequence. In the illustrative embodiment, the waveform period of speech data, generally ranging from 5 to 15 milliseconds, refers to the amount of shift having the maximum autocorrelation within the above range of course, the range of waveform period search may be broader or narrower than the above range, if desired.

On the other hand, a shift period is detected as information defining a speech data segment in the data memory 16 and is used to interpolate, when speech data are missing over two or more consecutive frames, speech data in frames that follow the second frame. A shift period is implemented by the amount of shift at the maximum peak autocorrelation value lying in a shift amount narrower than the waveform period. A shift period may be defined from another point of view. For example, an additional condition that the amount of shift corresponds to a peak autocorrelation value lying in the range of one-fourth to three-fourths of the waveform period may be used for decision.

Generally, a speech signal consists of a plurality of frequency components overlapping each other, so that a plurality of peak autocorrelation values appear even outside the waveform period. One of such a plurality of peak autocorrelation values that satisfies the preselected condition is used as a shift period.

The waveform and shift periods may be determined by any suitable method other than the method using an autocorrelation stated above, e.g. a method using frequency analysis.

Referring again to FIG. 1, the substitution controller 22 controls the entire compensating circuitry 10 to substitute speech data for an erased frame. The autocorrelation calculating circuit 20 uses the past predetermined number of speech data and the latest complete speech data as a reference to produce an autocorrelation. This means that the compensating circuitry 10 knows the last phase of a speech data sequence having appeared just before a frame in which speech data are missing.

The operation of the compensating circuit 10 with the above configuration will be described with reference made to FIGS. 3A through 3D and 4 as well. In the following description, the storage areas of the data memories 14 and 16 will be referred to as buffers A and B, respectively. Overlap Add processing described in ITU-T G.711 may be executed although not shown or described specifically.

While speech data input to the compensating circuitry 10 are written into the buffer A, as shown in FIG. 3, part [A], the content of the buffer A is updated every frame. The capacity of the buffer A may be, but not limited to, a few times as large as the maximum waveform period length.

When a frame whose speech data are erased occurs, the waveform and shift periods stated earlier are calculated from a speech data sequence saved in the buffer A and then memorized until the erasure of speech data ends. Further, the speech data sequence stored in the buffer A are copied into the buffer B in order to produce synthetic speech data for substitution and are held in the buffer B until the erasure ends. At this instant, one frame of synthetic speech data are produced from one waveform period of speech data, so that reconstructed waveform data or speech data are output.

First, a procedure for producing synthetic speech data for substitution will be described on the assumption that speech data are missing in only one frame. In this case, speech data to be used for substitution extend from a point just before an erasure occurs to a point one waveform period before the above point. This segment will sometimes be referred to as an active segment. As shown in FIG. 3, part [B], speech data having appeared one waveform period before the beginning of an erasure are used as the start point (311) of speech data for substitution. To produce speech data for substitution, speech data are used, extending from the start point (311) to the right end (313) of one waveform period If the speech data for substitution, labeled 301, are short of one frame even at the right end (313) of one waveform period, then the procedure returns to the left end (314).

When the procedure returns from the right end (313) to the left end (314) for producing speech data for substitution, it causes an segment at the left side of the right end (313) and an segment at the left side of the left end 314, corresponding to one-fourth of a period each, to overlap each other, thereby effecting continuous transition from the right end (313) to the left end (314). This overlap scheme is defined as "overlap add" in ITU-T Recommendation G.711. Likewise, an segment just before the erasure of speech and an segment at the left side of the first frame, corresponding to one-fourth of a period each, are caused to overlap each other, so that continuous transition occurs from the speech data just before the erasure to the synthetic speech data. The overlap scheme based on ITU-T Recommendation G.711 is only illustrative and may be replaced with any other scheme capable of continuously connecting speech waveforms.

How synthetic speech data for substitution are produced when speech is erased over two consecutive frames will be described hereinafter. For the first frame where speech data are missing, synthetic speech data are produced in the same fashion as when speech is missing in only one frame. Synthetic speech data for the second frame where speech data are also missing are generated by the following procedure.

First, as shown in FIG. 3, part [C], the active segment is shifted from the position used for the substitution of the first frame to the left by one shift period (320). Speech data (302) for substitution are produced from the resulting new active segment (326). The active segment (326) has a start point (321) determined in accordance with the following way.

The end point of the active segment used for the first frame is assumed to be a temporary start point (325), which is coincident with the end point (312) shown in FIG. 3, [B]. If the temporary start point (325) lies in the current active segment (326) between the left end (324) and the right end (323), the temporary start point (325) is used as an actual start point. If the temporary start point (325) does not lie in the current active segment (326), a point in an segment (326) shifted from the temporary start point (325) to the left by one waveform period is determined to be an actual start point (321). The generation of speech data for the second erased frame begins with speech data positioned at such an actual start point.

Again, an segment at the right side of the end point (312) of the first frame and an segment at the right side of the start point (321) of the second frame, corresponding to one-fourth of a period each, are caused to overlap each other so as to insure continuous transition from the speech data of the first frame to that of the second frame. The overlap scheme based on ITU-T Recommendation G.711 may be replaced with any other scheme capable of continuously connecting speech waveforms, as stated earlier.

When speech data are missing over three or more consecutive frames, synthetic speech data to be substituted in the third frame are produced in the same fashion as the synthetic speech data substituted in the second frame, i.e. by determining an active segment based on the shift period, determining a start point within the active segment, and then producing speech data for substitution, see FIG. 3, [D].

It should be noted that synthetic speech data to be substituted in the second and successive erased frames each are continuously attenuated before they are output. When the attenuation ratio exceeds 100%, ZEROs are output as speech data.

As for the third and successive frames, too, the active segment is sequentially shifted to the left frame by frame by one shift period at a time, as stated above. It is therefore likely that the active segment shifted to the left by one shift period exceeds the range of the buffer B. In such a case, synthetic speech data for substitution are produced by a procedure to be described with reference to FIG. 4 hereinafter.

Figure 4:
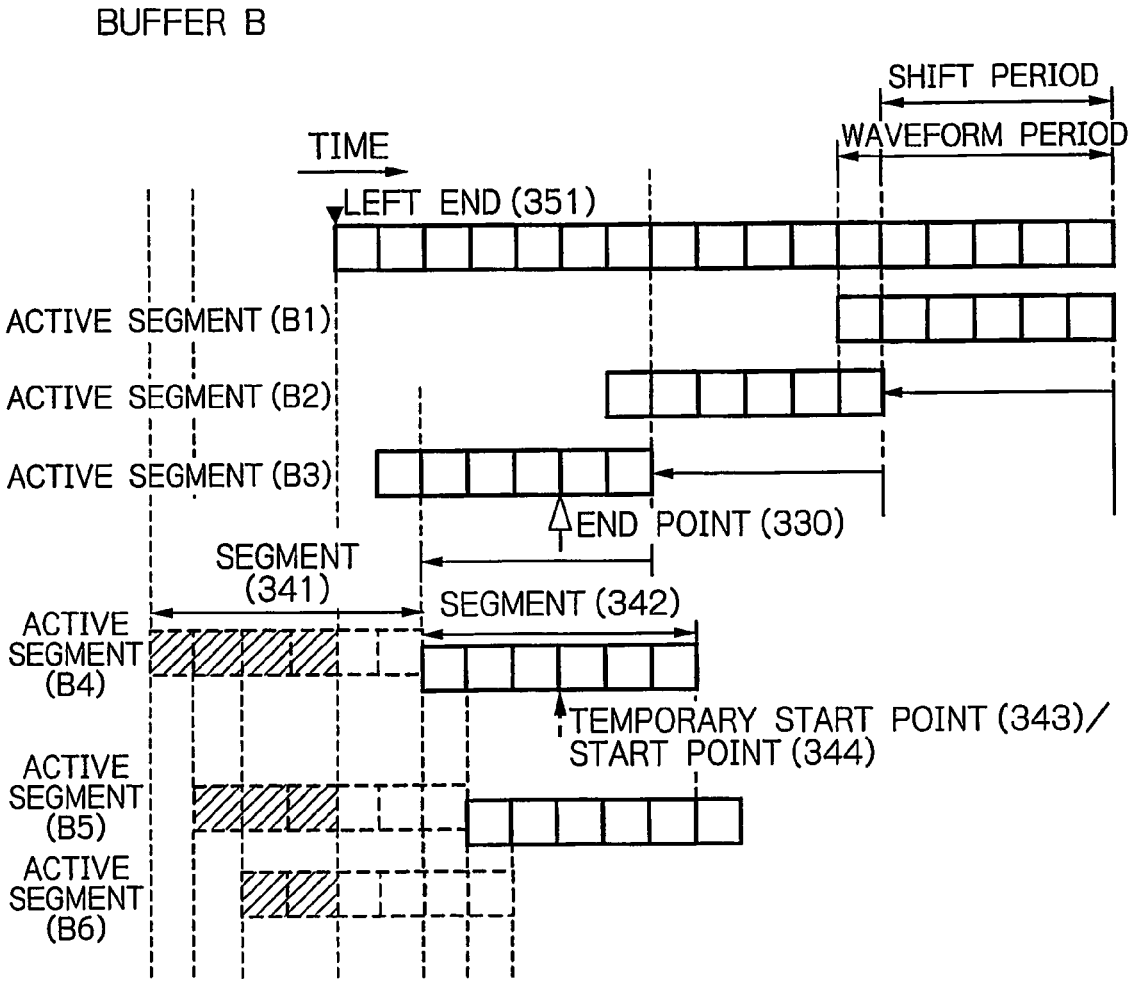
FIG. 4 shows a procedure to be also executed by the illustrative embodiment for determining a active segment, which delimits the range of past speech data to be used for substitution.

FIG. 4 demonstrates the variation of the active segment in the buffer B. As shown, for the second and successive frames, an active segment (B1) assigned to the first frame on the basis of the waveform period is sequentially shifted to active segments (B2) and (B3) frame by frame by one shift period at a time. As a result, it may occur that an active segment (341), following the active segment (B3), includes the left side of the left end (351) of the buffer B, as represented by an active segment (B4). In this case, the active segment (341) is shifted to the right by one waveform period, and the resulting segment is used as an active segment (342) for the generation of synthetic speech data.

More specifically, the active segment (342) has a start point (344) determined with the following manner. If a temporary start point (343), coincident with the end point (330) of the previous frame, lies in an segment (342), it is determined to be the start point. If the temporary start point 343 does not lie in the segment (342), the active segment (342) is sequentially shifted to the right by one waveform period at a time until the end point (330) of the previous frame enters the segment 342. When speech is missing even in the other frames to follow, active segments (B5) and (B6) each are shifted to the left by one shift period and then shifted, if exceeding the range of the buffer B, to the right by one waveform period.

When a complete speech data sequence again appears after the erasure, overlap processing based on the ITU-T G.711 standard should preferably be executed for insuring continuous transition from synthetic, substituted speech data to real speech data. At this instant, the overlap processing uses the right side of the end point of the last synthetic speech data and the start point of the real speech data. The above overlap processing may, of course, be replaced with any other processing capable of implementing a continuous transition.

As stated above, the illustrative embodiment produces synthetic speech data for substitution by calculating two different periods, i.e. a waveform period and a shift period and shifts frame by frame an active segment over which the past speech data are used on the basis of the calculated shift period. The active segment therefore sequentially moves while overlapping the previous active segment. This allows a memory with a small capacity to suffice for saving the past speech data and therefore reduces the scale of the entire compensating circuitry.

Of course, the illustrative embodiment is similarly practicable with the conventional memory having a large capacity, in which case a number of waveform data or active segments can be used. This allows synthetic speech data to include many kinds of variations and therefore sound natural. Stated in another way, with circuitry capable of using a larger memory capacity, it is possible to generate speech data that include more variations and therefore sound more natural.

Further, the illustrative embodiment shifts the active segment gradually and can therefore obviate the continuous generation of a single waveform undesirable as reconstructed speech. It follows that natural speech data can be substituted that obviate an unnatural feeling as to the auditory sense. Moreover, the illustrative embodiment determines the shift width of the active segment by use of the shift period derived from the waveform period, thereby insuring continuity of speech data.

An alternative embodiment of the speech erasure compensating circuitry in accordance with the present invention will be described with reference to FIG. 5. Because the illustrative embodiment is essentially similar to the previous embodiment, let the following description concentrate on a procedure unique to the illustrative embodiment. Briefly, the illustrative embodiment differs from the previous embodiment as to the method of determining an active segment when the active segment shifted to the left by the shift period exceeds the range of the buffer B.

Figure 5:
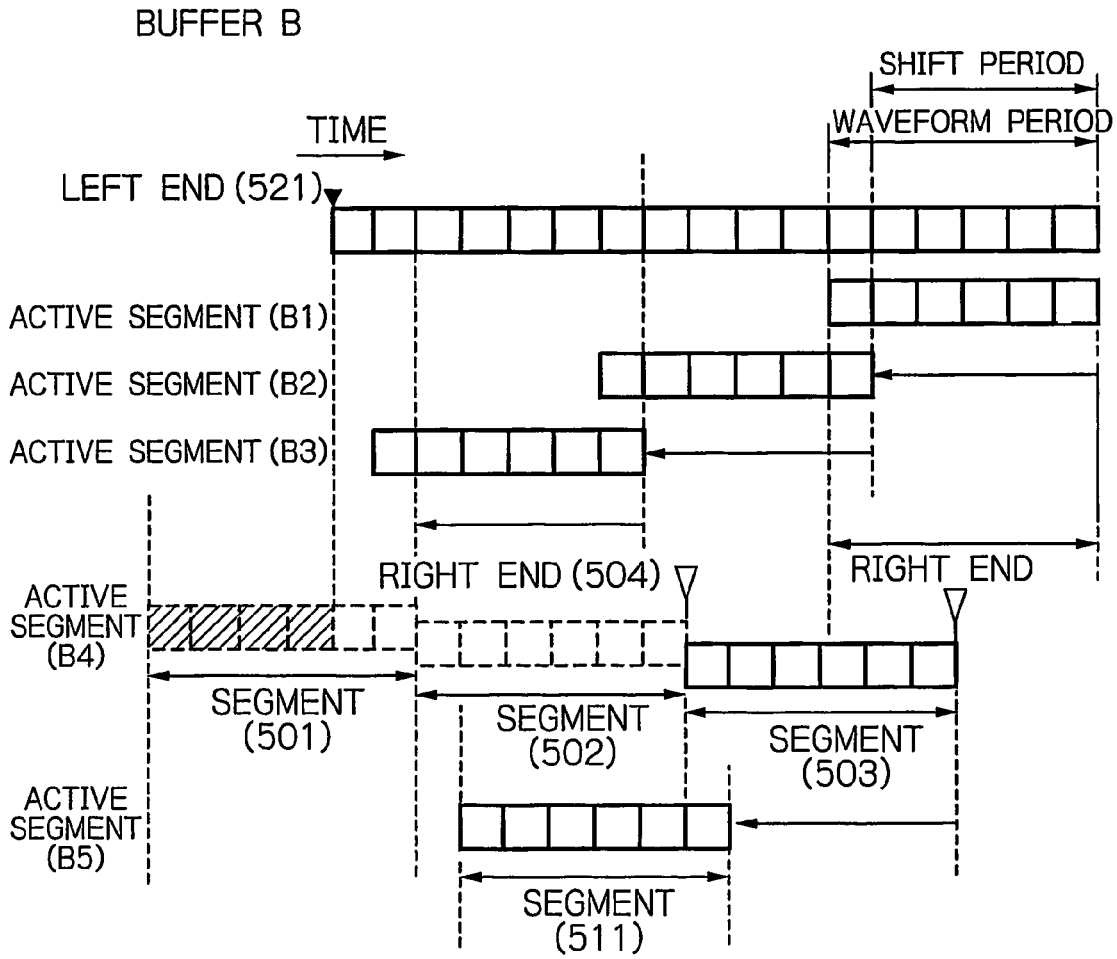
FIG. 5 shows an active segment determining procedure executed with an alternative embodiment of the present invention.

FIG. 5 shows the buffer B and how the active segment varies in the illustrative embodiment. Active segments (B1) through (B3) shown in FIG. 5 are identical with the active segments (B1) through (B3) shown in FIG. 4. As shown in FIG. 5, when a new active segment (501) resulting from a shift includes the left side of the left end (521) of the buffer B, as represented by an active segment (B4), another active segment (503) for the substitution of speech data are again determined by the following procedure.

First, the active segment is shifted from the active segment (501) to the right by one waveform period. Subsequently, it is determined whether or not the right end (504) of the resulting new active segment (502) lies in the range of one latest waveform period of the buffer B. If the answer of this decision is positive, then synthetic speech data for substitution are produced by use of the active segment (502). If the answer of the above decision is negative, the active segment is further shifted to the right by another waveform period in order to repeat the same decision. Such a procedure is repeated until the right end of the shifted active segment enters one latest waveform period.

More specifically, to determine the start point of the active segment (503) newly selected, the end point of the previous frame is sequentially shifted to the right by one waveform period at a time until the start point enters the active segment (503) as in the previous embodiment.

When the erasure of speech data continues even after the frame stated above, the active segment (503) is sequentially shifted to the left, as represented by an active segment (511).

As stated above, the illustrative embodiment is adapted to allow a synthesized speech to vary even when a long erasure frame is encountered. This is accomplished by the structure preventing an active segment from being consecutively involved in a particular range. This gives rise to maintaining the naturality in a synthesized speech reproduced, and preventing an undesired tonal sound to be output which would otherwise be caused by repetitive single waveforms.

Figure 6:
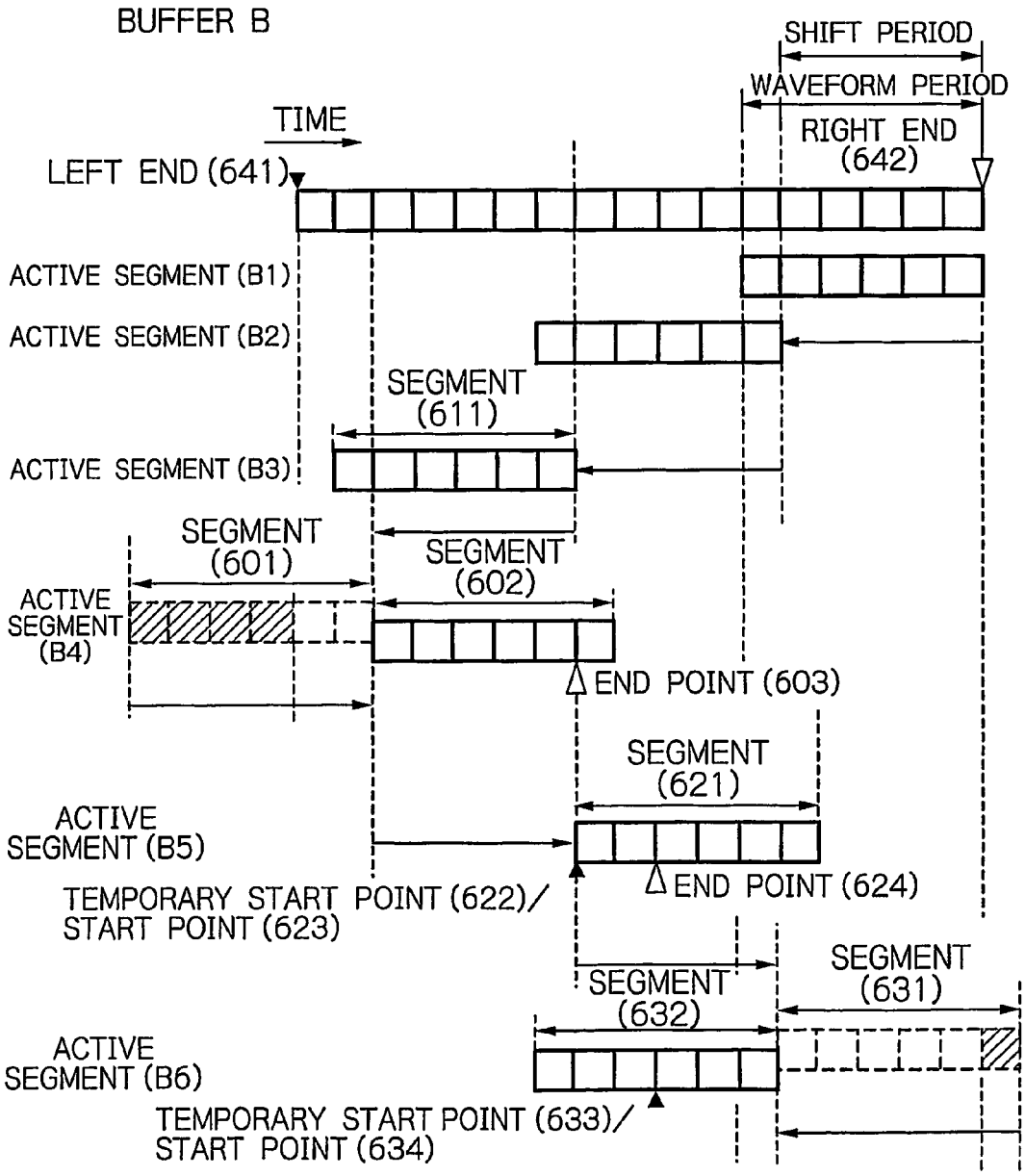
FIG. 6 shows an active segment determining procedure executed with another alternative embodiment of the present invention.

Reference will be made to FIG. 6 for describing another alternative embodiment of the speech erasure compensating circuitry in accordance with the present invention. The illustrative embodiment is also identical with the embodiment described with reference to FIGS. 3 and 4 except for the method of determining an active segment when the active segment shifted to the left by the shift period exceeds the range of the buffer B. FIG. 6 shows the buffer B and the variation of the active segment particular to the illustrative embodiment. Active segments (B1) through (B3) shown in FIG. 6 are identical with the active segments (B1) through (B3) shown in FIG. 4.

As shown in FIG. 6, when an active segment (601) newly determined by the leftward shift includes the left side of the left end (641) of the buffer B as represented by an active segment (B4), the active segment (601) is shifted to the right by one waveform period, and the resulting segment (602) is determined to be the active segment of the frame. If the temporary start point lies in the active segment (602), it is determined to be the start point of the active segment (602) as in the previous embodiment; otherwise, the temporary start point is shifted to the right by one waveform period and then used as a start point. The rightward shift is repeated when the erasure continuously occurs in the subsequent frames.

When an active segment (631) resulting from the repeated rightward shift effected on a shift period basis includes the right side of the right end (642) of the buffer B, a new active segment (632) is selected by shifting the active segment (631) to the left by one waveform period to thereby generate synthetic speech data. The start point (634) in the active segment (632) is determined in the same fashion as in the previous embodiment although the direction is opposite. When the erasure continuously occurs in the subsequent frames, the leftward shift of the active segment is repeated by the shift period at a time. The procedure described above is repeated until the erasure ends.

As stated above, the illustrative embodiment locates the active segments of nearby frames close to each other to thereby allow synthetic speech data for substitution to be also close to each other with respect to time. This insures continuity between substituted waveforms in nearby frames for thereby rendering transition between the frames natural.

Further, the illustrative embodiment is, like with the previous embodiment, so adapted to prevent an active segment from continuously existing in a particular range, a substituted speech is rendered variable. This prevents an undesired tonal sound to be reproduced that would otherwise be caused by repeating a single waveform.

Figure 7:
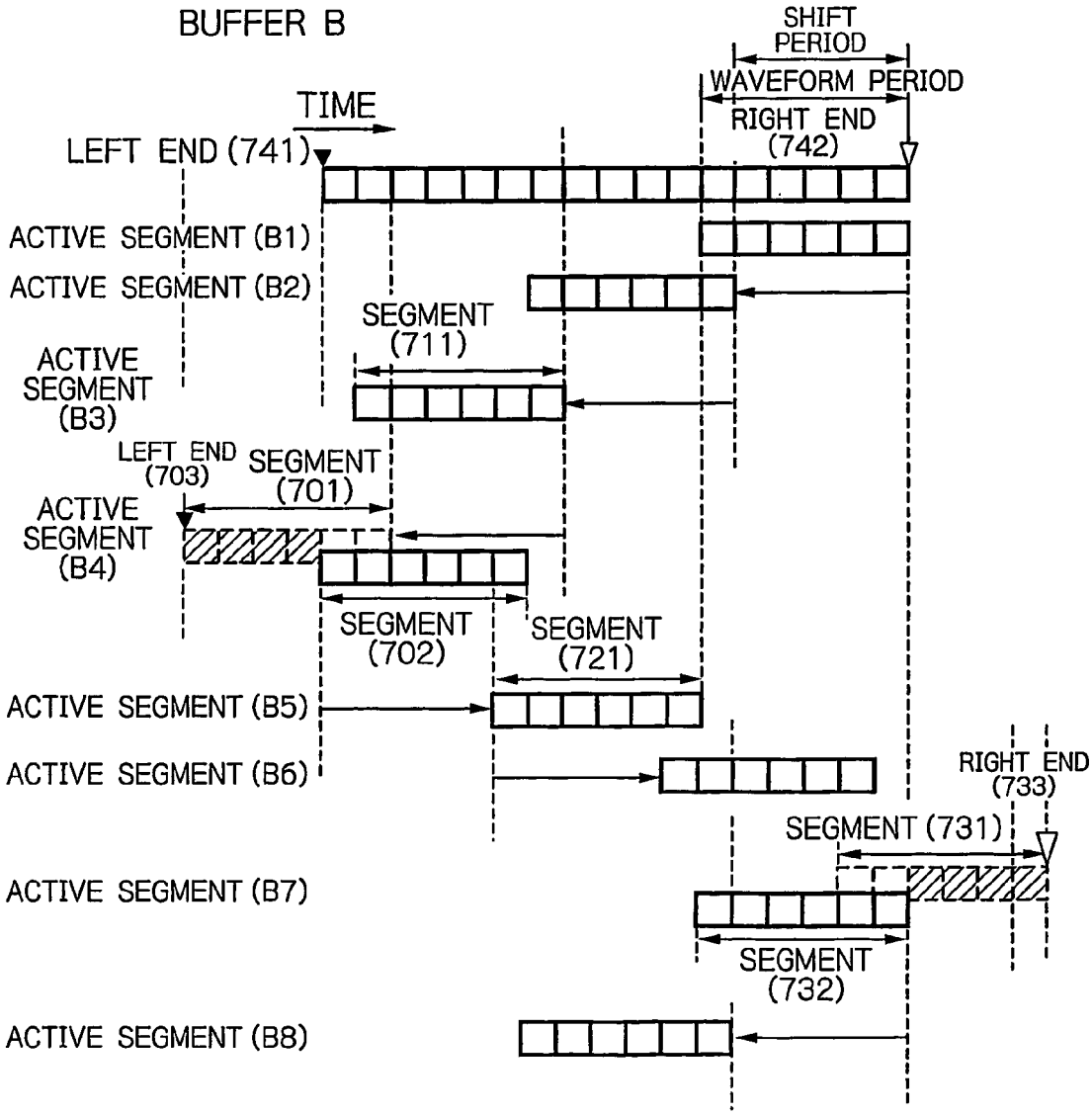
FIG. 7 shows an active segment determining procedure executed with a further alternative embodiment of the present invention.

Referring to FIG. 7, a further alternative embodiment of the speech erasure compensating circuitry will be described in accordance with the present invention. The illustrative embodiment is also identical with the embodiment described with reference to FIGS. 3 and 4 except for the method of determining an active segment when the active segment shifted to the left or right by the shift period exceeds the range of the buffer B. FIG. 7 shows the buffer B and the variation of the active segment particular to the illustrative embodiment. Active segments (B1) through (B3) shown in FIG. 7 are identical with the active segments (B1) through (B3) shown in FIG. 4.

As shown in FIG. 7, when an active segment (701), selected by shifting the immediately preceding active segment (711), includes the left side of the left end (741) of the buffer B, as represented by an active segment (B4), the active segment (701) is shifted to the right until the left end (703) of the segment (701) coincides with the left end (741) of the buffer B. The resulting new segment (702) is used as an active segment for the generation of synthetic speech data. As for the start point in the segment (702), the temporary start point is determined to be the start point if lying in the segment (702), or is otherwise shifted to the left by one waveform period as in the procedure shown in FIG. 4.

When the erasure continues even in the successive frames, the rightward shift of the active segment is repeated by the shift period at a time. A start point in each active segment is determined by the same method as in the procedure of FIG. 6.

When an active segment (731) resulting from the rightward shift includes the right side of the right end (742) of the buffer B, as represented by an active segment (B7), the segment (731) is shifted to the left until the right end (733) of the segment (731) coincides with the right end (742) of the buffer B. An segment (732) determined by such a leftward shift is used as an active segment for the generation of synthetic speech data.

Again, when the erasure continues even in the successive frames, the leftward shift of the active segment is repeated by the shift period at a time. A start point in each active segment may also be determined by the same method as in the procedure of FIG. 6.

When erased frames continuously occur over a long period of time, the illustrative embodiment can use the entire range of speech data saved in the buffer B for the generation of substitutive speech data without fail and can therefore output substituted speech that sounds natural. The illustrative embodiment is easily practicable with a memory having a small capacity.

Further, the illustrative embodiment allows the waveform of substituted speech to contain the variation of the entire buffer B and, at the same time, obviates an undesirable tone ascribable to a single continuous waveform.

Figure 8:
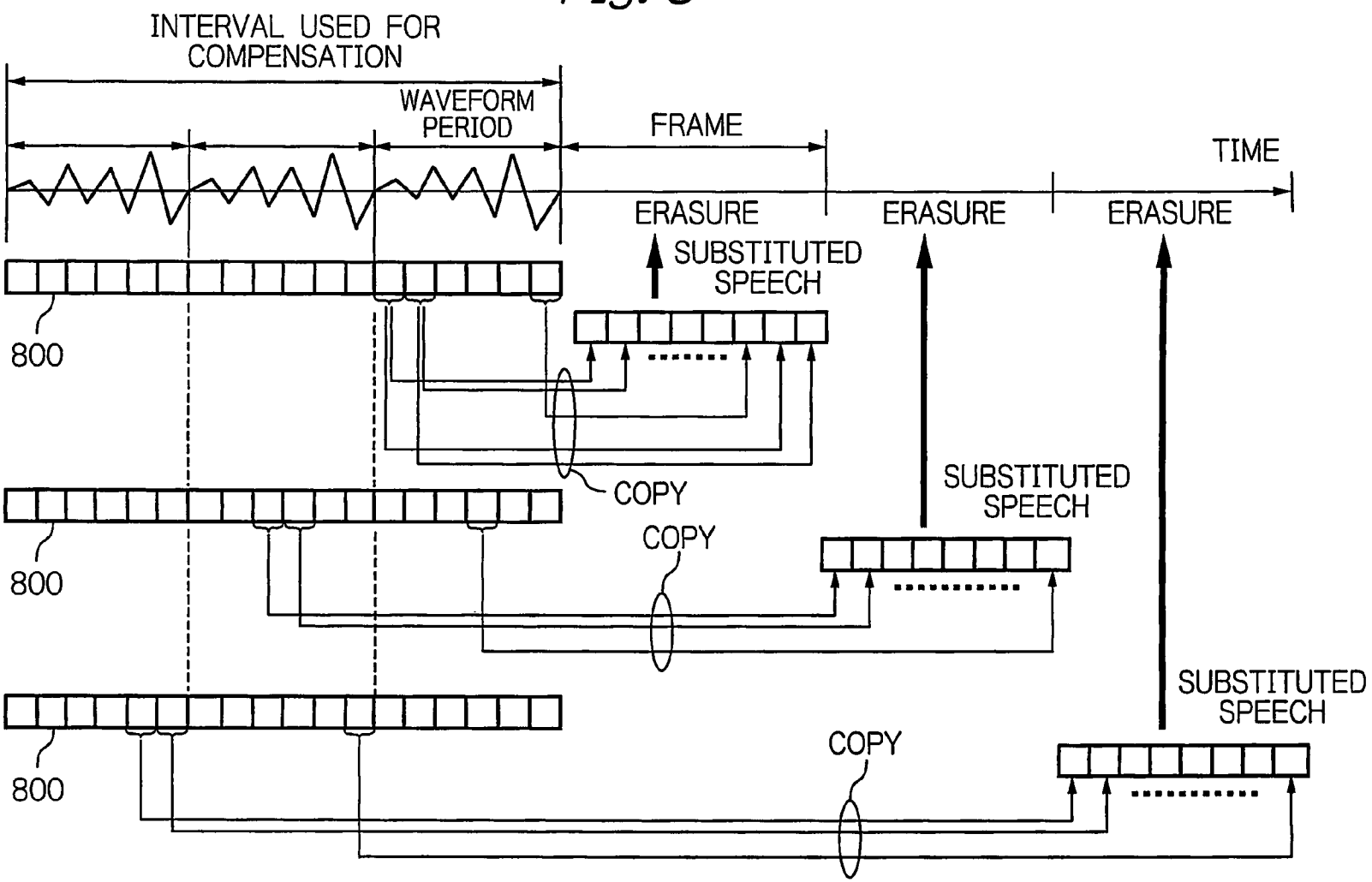
Fig. 8 PRIOR ART
FIG. 8 shows a conventional speech erasure compensating method.

FIG. 8 demonstrates a conventional speech erasure compensating method using an internal memory 800 whose capacity is large enough to store speech data over, e.g. up to three waveform periods. The speech data thus stored in the memory 800 are used to obviate a tone ascribable to a single continuous waveform. This method, however, scales up the memory 800 and access configuration thereof, increasing the scale of the entire compensating circuitry.

Moreover, in accordance with the method of FIG. 8, when erased frames continuously occur, an segment to be used for the generation of synthetic speech data are extended on a waveform period basis. Consequently, for consecutive erased frames, speech data for the generation of speech data are collected from a broad range, tending to degrade the natural variation of substituted speech.

By contrast, the illustrative embodiments of the present invention shown and described shift the position of speech data for gradual substitution for thereby shifting an segment to be used. The erasure of a speech signal can therefore be compensated without lowering signal quality despite that speech data are not saved over three waveform periods.

While the illustrative embodiments have been shown and described as determining a shift period at all times, a shift period may not be determined in some circumstances, in which case the conventional compensation procedure will be executed. For example, if an erased frame is representative of an unvoiced segment whose correlation is small, as determined by the comparison of a difference between autocorrelation values and a preselected threshold or the comparison of a ratio between autocorrelation values and a preselected threshold, by way of example, then a shift period may not be determined.

The illustrative embodiments select, among periods shorter than a waveform period, a period having the largest autocorrelation value as a shift period. Alternatively, there may be selected, among a plurality of amounts or periods of shift having autocorrelation values larger than a preselected value, a period closest to or farthest from a waveform period.

If desired, a single shift period determined in the illustrative embodiments may be replaced with a plurality of shift periods. For example, a shift of an active segment using a first shift period and a shift of the same using a second shift period may be alternately effected. Further, random numbers may be selectively used for each shift.

While an active segment used in the illustrative embodiments is coincident with a waveform period, the active segment may be provided with a frame length or similar fixed length, in which case the shift period must be shorter than the active segment. Even when the active segment is fixed, a start point in an active segment after a shift is determined by use of the waveform period.

In the illustrative embodiments, overlap processing is suitably executed in the event of substitution. It should also be noted that the illustrative embodiments are applicable not only to a speech signal shown and described, but also to any other periodic signal, e.g. a music signal or a signal having a sinusoidal waveform.

In summary, it may have be seen that the present invention provides circuitry capable of substituting for erased part of a periodic signal without degrading signal quality.

The entire disclosure of Japanese patent application No. 2003-136338 filed on May 14, 2003, including the specification, claims, accompanying drawings and abstract of the disclosure is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

The invention claimed is:

1. Compensating circuitry for substituting for erased periodic signal data periodic signal data input before the erased periodic signal data, comprising:

a past data saving circuit configured to save a predetermined number of latest periodic signal data input;

a decision circuit configured to determine whether or not an erasure occurs with every periodic signal data sequence, which is a unit of processing;

a substituting circuit configured to use, when an erasure occurs, a periodic signal data sequence lying in a predetermined segment to be used among periodic signal data sequences saved in said past data saving circuit, to generate synthetic data for substitution; and a position controller configured to determine, when the erasure has occurred over a plurality of units of processing, a position of the segment to be used such that the position varies for each of the units of processing, said position controller calculating periods of the periodic signal data sequences saved in said past data saving circuit and selecting, among the periods calculated, a period shorter than a width of the segment to be used as an index for varying the segment for every processing frame.

2. The circuitry in accordance with claim 1, wherein said position controller calculates periods of the periodic signal data sequences saved in said past data saving circuit and selects, among the periods calculated, a waveform period having highest periodicity as a width of the segment to be used.

3. The circuitry in accordance with claim 1 wherein the periodic signal comprises a speech signal.

4. Compensating circuitry for substituting for erased periodic signal data periodic signal data input before the erased periodic signal data, comprising:

a past data saving circuit configured to save a predetermined number of latest periodic signal data input;

a decision circuit configured to determine whether or not an erasure occurs with every periodic signal data sequence, which is a unit of processing;

a substituting circuit configured to use, when an erasure occurs, a periodic signal data sequence lying in a predetermined segment to be used among periodic signal data sequences saved in said past data saving circuit, to generate synthetic data for substitution; and a position controller configured to determine, when the erasure has occurred over a plurality of units of processing, a position of the segment to be used such that the position varies for each of the units of processing, said position controller sequentially shifting the position of the segment to be used from a newest periodic signal data sequence toward an oldest periodic signal data sequence saved in said past data saving circuit and determining, when the segment cannot be further shifted toward the oldest period signal data sequence, the segment at a position adjacent to the oldest periodic signal data sequence.

5. Compensating circuitry for substituting for erased periodic signal data periodic signal data input before the erased periodic signal data, comprising:

a past data saving circuit configured to save a predetermined number of latest periodic signal data input;

a decision circuit configured to determine whether or not an erasure occurs with every periodic signal data sequence, which is a unit of processing;

a substituting circuit configured to use, when an erasure occurs, a periodic signal data sequence lying in a predetermined segment to be used among periodic signal data sequences saved in said past data saving circuit, to generate synthetic data for substitution; and a position controller configured to determine, when the erasure has occurred over a plurality of units of processing, a position of the segment to be used such that the position varies for each of the units of processing, said position controller sequentially shifting the position of the segment to be used from a newest periodic signal data sequence toward an oldest periodic signal data sequence saved in said past data saving circuit, again sequentially shifting, when the segment cannot be further shifted toward the oldest period signal data sequence, the segment from the newest periodic signal data sequence toward the oldest period signal data sequence, and repeating a variation effected by a shift so long as the erasure continues.

6. Compensating circuitry for substituting for erased periodic signal data periodic signal data input before the erased periodic signal data, comprising:

a past data saving circuit configured to save a predetermined number of latest periodic signal data input;

a decision circuit configured to determine whether or not an erasure occurs with every periodic signal data sequence, which is a unit of processing;

a substituting circuit configured to use, when an erasure occurs, a periodic signal data sequence lying in a predetermined segment to be used among periodic signal data sequences saved in said past data saving circuit, to generate synthetic data for substitution; and a position controller configured to determine, when the erasure has occurred over a plurality of units of processing, a position of the segment to be used such that the position varies for each of the units of processing, said position controller sequentially shifting the position of the segment to be used from a newest periodic signal data sequence toward an oldest periodic signal data sequence saved in said past data saving circuit, sequentially shifting, when the segment cannot be further shifted toward the oldest period signal data sequence, the segment from the oldest periodic signal data sequence toward the newest period signal data sequence, sequentially shifting, when the segment cannot be further shifted toward the newest periodic signal data sequence, the segment from the newest periodic signal data sequence toward the oldest periodic signal data sequence, and repeating a variation effected by a shift so long as the erasure continues.

7. A compensating method for substituting for erased periodic signal data periodic signal data input before the erased periodic signal data, comprising:

a past data saving step of saving a predetermined number of latest periodic signal data input;

a deciding step of determining whether or not erasure occurs with every periodic signal data sequence, which is a unit of processing;

a substituting step of using, when an erasure occurs, among periodic signal data sequences saved in said past data saving step, a periodic signal data sequence lying in a predetermined segment to be used to generate data for substitution; and a position controlling step of determining, when the erasure has occurred over a plurality of units of processing, a position of the segment to be used such that the position varies for each of the units of processing, said position controlling step calculating periods of the periodic signal data sequences saved in said past data saving step and selecting, among the periods calculated, a period shorter than a width of the segment to be used as an index for varying the segment for every processing frame.

8. The method in accordance with claim 7 wherein said position controlling step calculates periods of the periodic signal data sequences saved in said past data saving step and selects, among the periods calculated, a waveform period having highest periodicity as a width of the segment to be used.

9. The method in accordance with claim 7, wherein the periodic signal comprises a speech signal.

10. A compensating method for substituting for erased periodic signal data periodic signal data input before the erased periodic signal data, comprising:

a past data saving step of saving a predetermined number of latest periodic signal data input;

a deciding step of determining whether or not erasure occurs with every periodic signal data sequence, which is a unit of processing;

a substituting step of using, when an erasure occurs, among periodic signal data sequences saved in said past data saving step, a periodic signal data sequence lying in a predetermined segment to be used to generate data for substitution; and a position controlling step of determining, when the erasure has occurred over a plurality of units of processing, a position of the segment to be used such that the position varies for each of the units of processing, said position controlling step sequentially shifting the position of the segment to be used from a newest periodic signal data sequence toward an oldest periodic signal data sequence saved in said past data saving step and, when the segment cannot be further shifted toward the oldest period signal data sequence, the segment at a position adjacent to the oldest periodic signal data sequence.

11. A compensating method for substituting for erased periodic signal data periodic signal data input before the erased periodic signal data, comprising:

a past data saving step of saving a predetermined number of latest periodic signal data input;

a deciding step of determining whether or not erasure occurs with every periodic signal data sequence, which is a unit of processing;

a substituting step of using, when an erasure occurs, among periodic signal data sequences saved in said past data saving step, a periodic signal data sequence lying in a predetermined segment to be used to generate data for substitution; and a position controlling step of determining, when the erasure has occurred over a plurality of units of processing, a position of the segment to be used such that the position varies for each of the units of processing, said position controlling step sequentially shifting the position of the segment to be used from a newest periodic signal data sequence toward an oldest periodic signal data sequence saved in said past data saving step, again sequentially shifting, when the segment cannot be further shifted toward the oldest period signal data sequence, the segment from the newest periodic signal data sequence toward the oldest period signal data sequence, and repeating a variation effected by a shift so long as the erasure continues.

12. A compensating method for substituting for erased periodic signal data periodic signal data input before the erased periodic signal data, comprising:

a past data saving step of saving a predetermined number of latest periodic signal data input;

a deciding step of determining whether or not erasure occurs with every periodic signal data sequence, which is a unit of processing;

a substituting step of using, when an erasure occurs, among periodic signal data sequences saved in said past data saving step, a periodic signal data sequence lying in a predetermined segment to be used to generate data for substitution; and a position controlling step of determining, when the erasure has occurred over a plurality of units of processing, a position of the segment to be used such that the position varies for each of the units of processing, said position controlling step sequentially shifting the position of the segment to be used from a newest periodic signal data sequence toward an oldest periodic signal data sequence saved in said past data saving step, sequentially shifting, when the segment cannot be further shifted toward the oldest period signal data sequence, the segment from the oldest periodic signal data sequence toward the newest period signal data sequence, sequentially shifting, when the segment cannot be further shifted toward the newest periodic signal data sequence, the segment from the newest periodic signal data sequence toward the oldest periodic signal data sequence, and repeating a variation effected by a shift so long as erasure continues.

* * * * *